United States Patent [19]

Jonsson

[11] Patent Number: 4,754,789

[45] Date of Patent: Jul. 5, 1988

[54] THREE-EDGED WOODWORKING TOOL FOR A WOODWORKING MACHINE

[76] Inventor: Karl-Erik A. Jonsson, Floraplan 14, S-802 28 Gävle, Sweden

[21] Appl. No.: 12,478

[22] Filed: Feb. 9, 1987

[30] Foreign Application Priority Data

Aug. 27, 1986 [SE] Sweden ..... 8603618

[51] Int. Cl.[4] ..... B27G 13/08

[52] U.S. Cl. ..... 144/241; 144/176; 144/218; 241/92; 241/298; 407/113; 407/117

[58] Field of Search ..... 144/176, 218, 241, 162 R; 241/92, 189 R, 278 R, 296; 407/113, 117

[56] References Cited

U.S. PATENT DOCUMENTS 4,271,882 6/1981 Valo ..... 144/241
4,545,413 10/1985 Sunberg et al. ..... 144/241
4,669,516 6/1987 Carpenter ..... 144/241

*Primary Examiner*—W. Donald Bray

*Attorney, Agent, or Firm*—Pollock, Vande Sande & Priddy

[57] ABSTRACT

A three-edged tool (12) for a woodworking machine. The edges (18,19,20) of the tool are arranged with equal angular spacing about a tool body and protrude therefrom. In the surfaces (24,25,26) between the edges are recesses (27,28,29) so shaped as to retain the tool by mating engagement with a correspondingly shaped protrusion (30) provided on a tool carrier (10), and to act as a kerf in order to guide a break in case of overload of an edge (18) to the area between two recesses (27,28). Fastening means for the tool include a support part (14) provided on the tool carrier and a clamping part (15). The support part (14) carries the protrusion (30), which is shaped to engage in a recess (28) of the tool, and has a support surface (14') for supporting a clearance surface of an edge (19) which is inactive when the tool is mounted on the tool carrier. The clamping part (15) has a clamping surface (22) which is adapted to press against the clearance surface of the second inactive edge (20) of the tool.

7 Claims, 5 Drawing Sheets

THREE-EDGED WOODWORKING TOOL FOR A WOODWORKING MACHINE

FIELD OF THE INVENTION

The present invention concerns a three-edged woodworking tool for a woodworking machine, the edges being arranged with equal angular spacing about a tool body and protruding therefrom, surfaces for co-operation with means for fastening the tool to a tool carrier being arranged between said edges. The invention also concerns fastening means for the tool.

PRIOR ART

A tool according to the above, and fastening means therefor, are known from U.S. Pat. No. 4,271,882. This tool has the cross-sectional shape of a three-pointed star, the points of which constitute the edges of the tool. Each edge is defined by two plane surfaces, and between the opposed plane surfaces of two edges there is a connecting surface, such that each side of the star profile obtains a Z- or zig-zag shaped appearance. The tool is fastened to a tool carrier having a seat shaped in conformity with a tool side. A fastening means, likewise shaped in conformity with a tool side, engages one of the tool edges, a connecting surface and a portion of the edge, which is the active edge.

This known tool and its associated fastening means have some serious deficiencies:

The fastening means serves as chip deflector, which means that this relatively expensive part is exposed to hard wear;

Upon breakage of the active edge the fastening means loses a great part of its support and may then be so deformed that it will not fit after turning of the damaged tool or after change to a new tool;

It is uncertain where a possible tool breakage will occur and how the surfaces of rupture will affect the possibilities to re-mount the tool after turning without previous machining.

SUMMARY OF THE INVENTION

The object of this invention is to provide a new tool for woodworking machines, such as chippers, and fastening means therefor, which do not possess the deficiencies mentioned.

The tool according to the invention, which is an article of consumption and, in comparison to the fastening means, a cheap detail, has been shaped to receive all wear resulting from the working and to prevent damage of the fastening means in case foreign objects enter the working machine.

Thus, the tool itself serves with one of its sides as a chip deflector to guide the cut chips out through the chip opening. Therefore, because the fastening means is not exposed to the chip flow where it is the most aggressive, but only when it has been diverted to a direction approximately tangent to the fastening means, the fastening means (the clamping part) is exposed to practically no wear.

A breakage of a tool edge does not expose the fastening means to any further risk, since the remaining tool body effectively protects it (the support part) against every form of damage.

By means of the recesses in the tool body, which serve both for attachment of the tool and as kerfs (indications of fracture), a possible edge breakage is guided just to the area between two recesses, and hence there is greater certainty that the surfaces of rupture do not detrimentally affect the re-mounting of the tool in a turned position.

BRIEF DESCRIPTION OF THE DRAWINGS

The invention will be described hereinafter with reference to the accompanying drawings, wherein.

DETAILED DESCRIPTION

Figure 1:
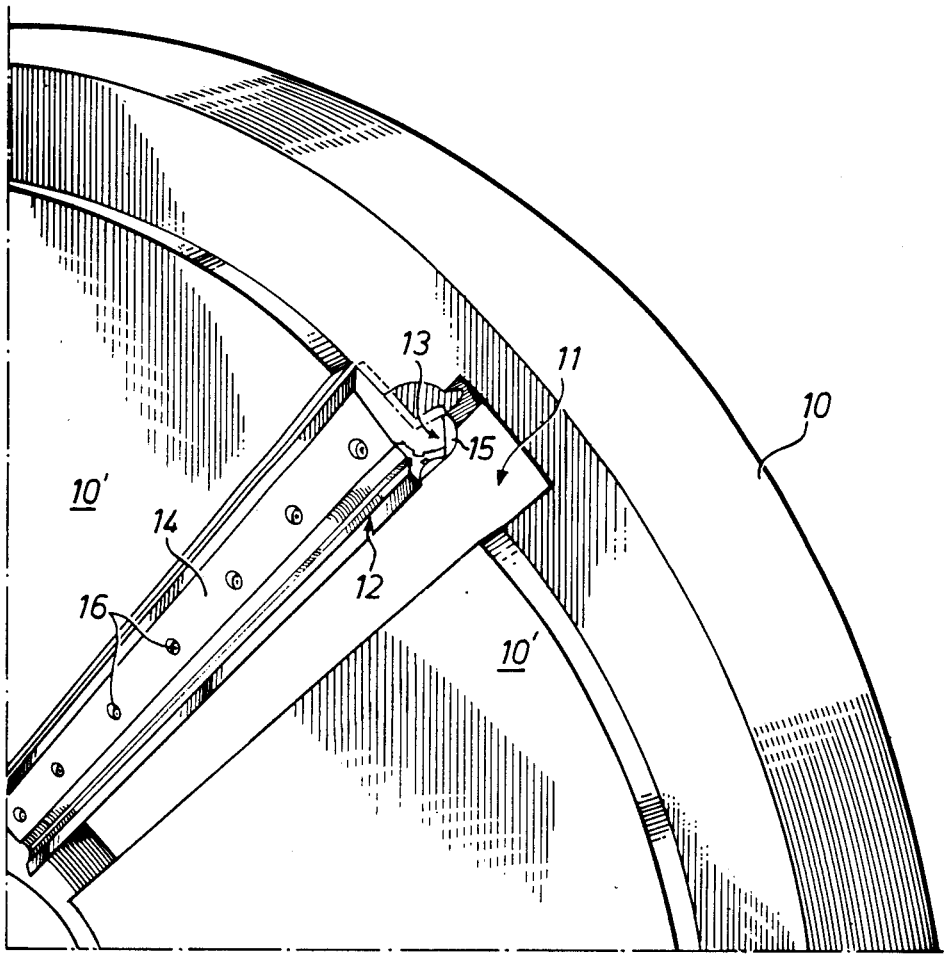
FIG. 1 is a perspective view showing the tool and the fastening means mounted in a tool carrier in the shape of a chipper disc.
Figure 3:
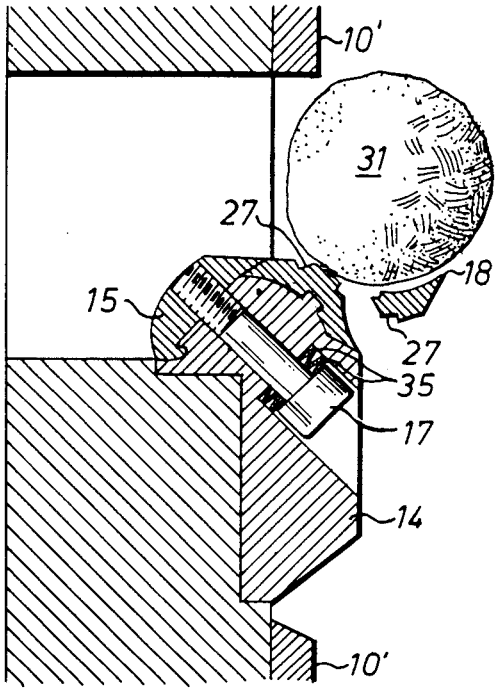
FIG. 3 is a sectional view similar to that according to FIG. 2, the tool being subject to an edge break.
Figure 4:
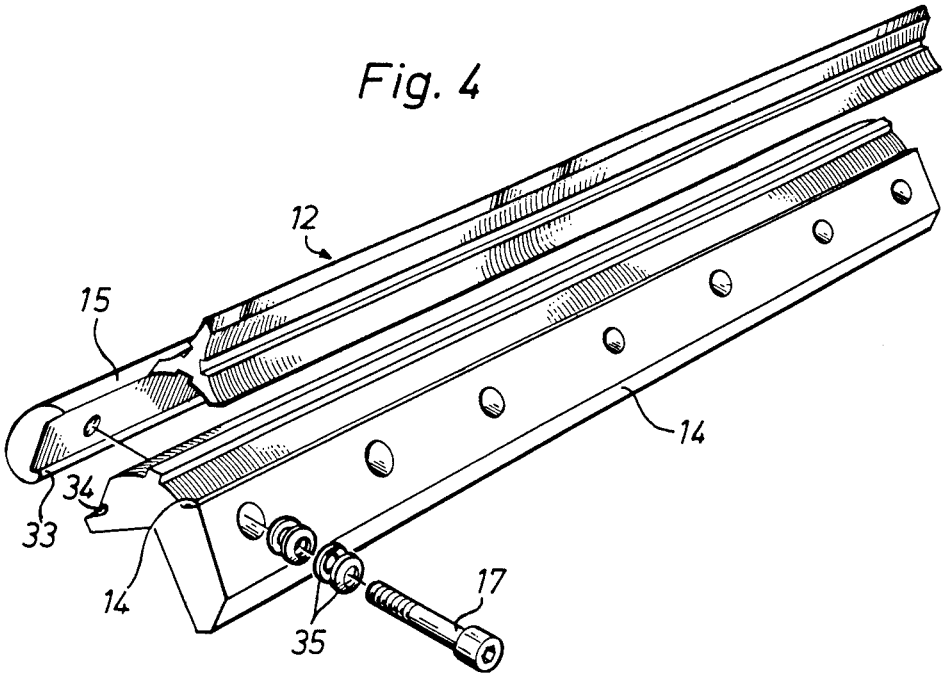
FIG. 4 is an exploded perspective view showing the tool according to the invention and its fastening means.

FIG. 1 shows a sector of a disc 10 for a chipper rotatable about an axis (not shown). In the disc 10, which is provided with a wear plate 10', there are a plurality of substantially radially arranged chip openings 11, one of which is shown in FIG. 1. In the trailing edge of the opening 11, as seen in the direction of rotation, there is mounted a tool 12 according to the invention. The tool 12 is mounted by means of a fastening means 13 according to the invention including a part 14 attached to the tool carrier and, due to its function, hereinafter referred to as a support part, and a part 15 which due to its function, hereinafter is referred to as clamping part. The support part 14 is intended to be permanently attached to the tool carrier 10, but for practical reasons it is detachably attached thereto, by means of screws 16, as more clearly appears from FIG. 2. The clamping part 15 is detachably fastened to the support part 14 by means of screws 17 (FIGS. 3 and 4).

Figure 2:
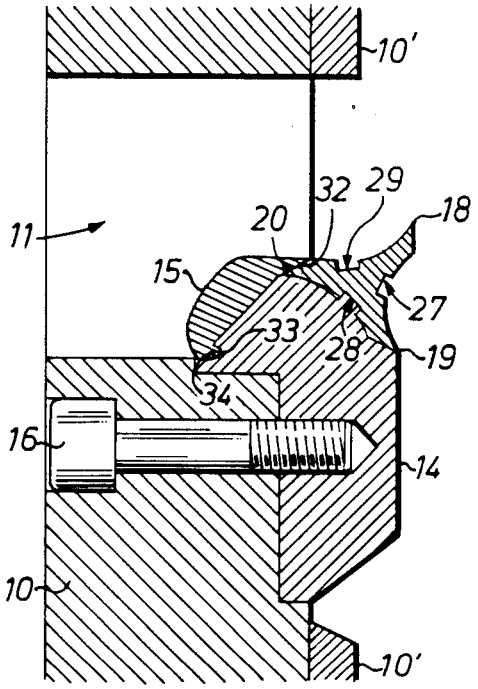
FIG. 2 is a sectional view through the tool and the fastening means and a portion of the tool carrier.
Figure 6:
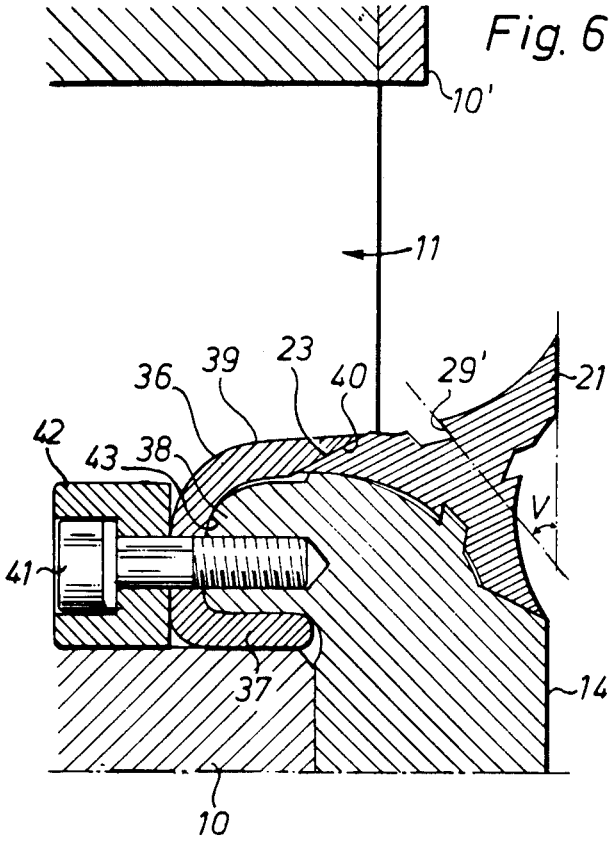
FIG. 6 shows another embodiment of the fastening means and a tool according to FIGS. 1–5.
Figure 5:
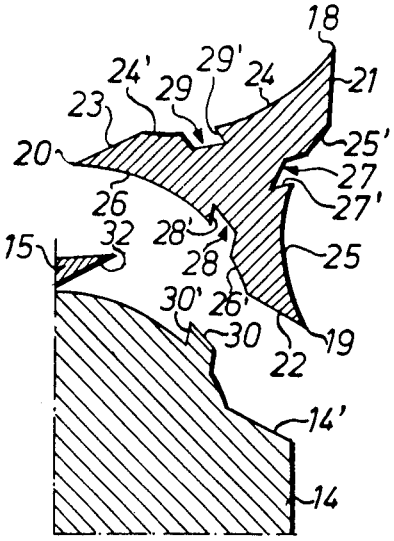
FIG. 5 shows in somewhat larger scale a section through the tool and the fastening eans according to FIGS. 1 to 4, separated for the sake of clarity.
Figure 8:
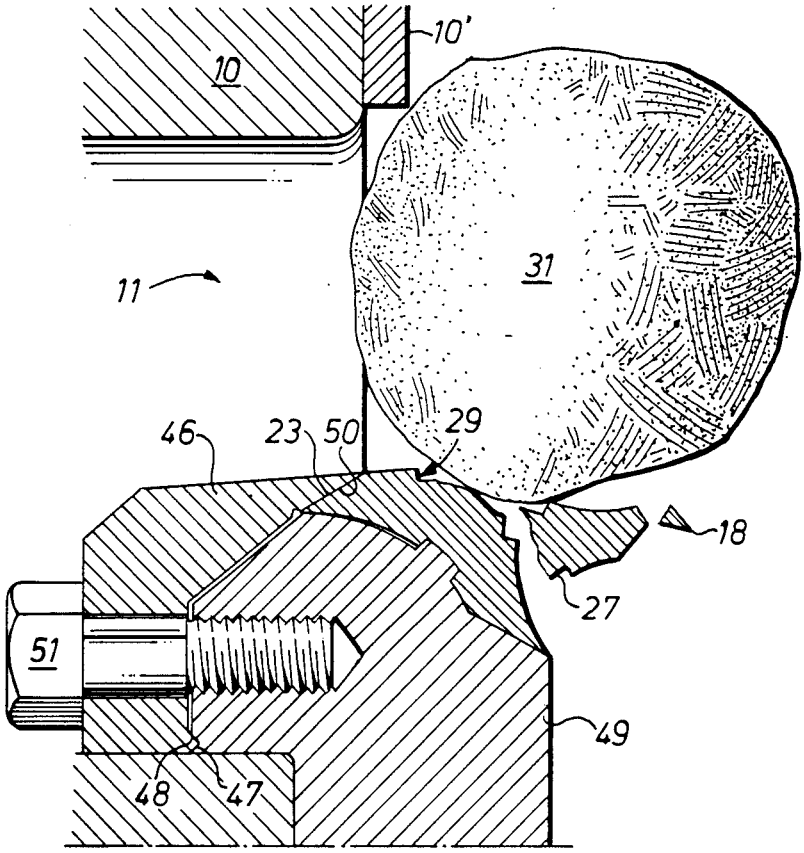
FIG. 8 shows a further embodiment of the fastening means and the tool of FIGS. 1–5.

FIG. 2, and in more detailed from FIG. 6, shows the co-operating sectional shapes of the tool 12 and the parts 14 and 15 of the fastening means. The tool 12 substantially has the shape of a three-pointed, somewhat helical star, the edges 18,19 and 20 of the tool being located at the points of the star. The edges have substantially plane clearance surfaces 21, 22 and 23. On the chip side, however, the chip surfaces of the edges convert into concavely curved chip deflecting surfaces 24, 25 and 26, respectively. These surfaces may closely approximate to a circular arc-shape, but may also, depending on the edge angle chosen, have other curved shapes. The trailing portions 24', 25' and 26', respectively, as seen in the direction of chips, of the chip deflecting surfaces connect to the clearance surface 23, 22 and 21, respectively, of the adjacent edge. Between the edges, each chip deflecting surface has a recess or groove 27, 28 and 29, respectively, which serves both for engagement with a corresponding protrusion 30 on the support part 14 of the fastening means 13, and as a kerb in case the active edge should be overloaded. Such cases are shown in FIGS. 3 and 8, where the edge 18 has been broken by a stone 31. The support part 15 has a support surface 14' intended to support the clearance surface (in FIG. 5, surface 22) of the inactive edge located underneath the active edge.

The grooves 27, 28, 29 and the protrusion 30 have co-operating support surfaces 27', 28', 29' and 30', respectively. In the operative position of the tool 12 a groove support surface (e.g. surface 28' of FIG. 5) rests against the protrusion support surface 30' at the same time as the clamping part 15 with a clamping surface 32 presses against a clearance surface (23 in FIG. 5). In order to ascertain fastening of the tool, an angle is formed between a groove support surface and the clearance surface simultaneously being operative for clamping of the tool. For the sake of clarity, one such angle v is shown in FIG. 6 only between the non-operative groove support surface 29' and the clearance surface 21. The same of substantially the same angle exists between the protrusion support surface 30' and the clamping surface of the clamping part in view (e.g., clamping surface 32 of FIG. 5). Hereby is achieved the wedge action between the surfaces of the fastening means and the surfaces of the tool co-operating therewith that is necessary for the clamping principle utilized.

Suitably the clamping part 15 is shaped such that, upon tightening of the screw(s) 17, it is subject to prestressing, e.g., by resting only with its end areas (as viewed in cross-section) against the support part 14 and the tool, respectively. In FIGS. 2 and 3 the clamping part 15 supports itself in one of its end areas with a rounded portion 33 in a corresponding recess 34 in the support part 14 and in the other end area with the clamping surface 32 against the clearance surface 23 of the tool. The portion 33 and the recess 34 also serve for the mutual guidance between the clamping part 15 and the support part 14 upon clamping of the tool.

For elastic clamping a number of spring washers 35 may also be arranged between the heads of the screws 17 and the support part 14.

In the embodiment of the fastening means according to FIG. 6 the clamping part 36 engages with one leg 37 between a bulge 38 of the support part 14 and a surface of the chip opening 11 of disc 0. The other leg 39 of the clamping part 36 presses with a support surface 40 against the clearance surface 23 of the tool as a clamping device comprising screws 41 and a pressure bar 42 presses the web portion 43 of the clamping part 36 against the bulge 38.

Figure 7:
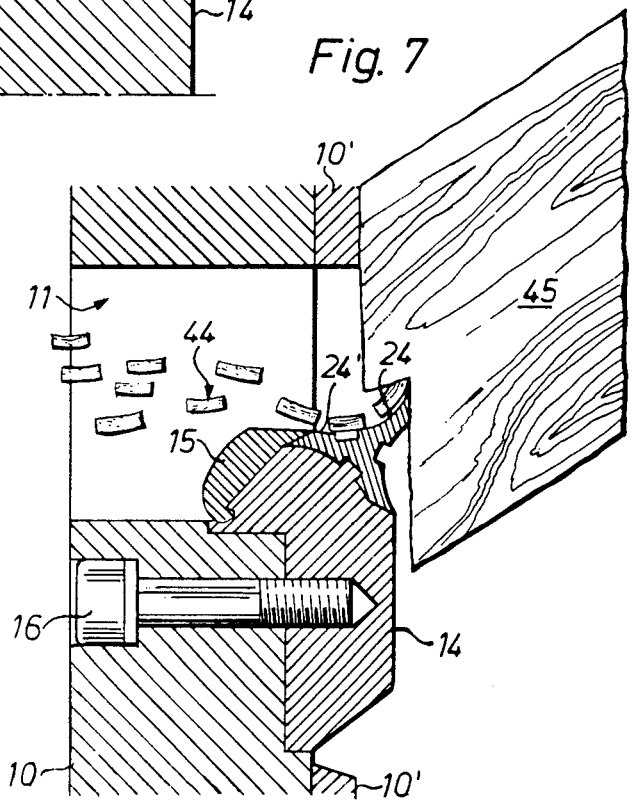
FIG. 7 is a sectional view similar to that of FIG. 2 showing chipping of a piece of wood.

FIG. 7 shows how the flow of chips 44 from a piece of wood 45 cut with the embodiment according to FIGS. 1–5 is deflected by the chip deflecting surface 24,24' such that the clamping part is protected from wear.

In order to further protect the upper exposed surface 15' of the clamping part and also the trailing parts (e.g., 24') of the chip deflecting surfaces, the chip deflecting surfaces 24, 25, 26 may have a smaller radius at the leading edges of the recesses 29, 27, 28 than at the trailing edges of the recesses (counted from one and the same center). By means of a level of difference between the edges of the recess created in this or another manner the chip flow is directed over the trailing edge, over the succeeding part of the chip deflecting surface and also over the clamping part 15.

FIG. 8 shows a further variant of fastening means, wherein clamping part 46 engages only with a wedge shaped protrusion 47 in a corresponding groove 48 in the support part 49, and with a support surface 50 presses against the clearance surface 23 of the tool. A screw 51 pulls the clamping part 46 against the support part 49. Also here the mutual guidance between the clamping part 46 and the support part 49 takes place by engagement of the protrusion 47 in the groove 48.

Figure 9:
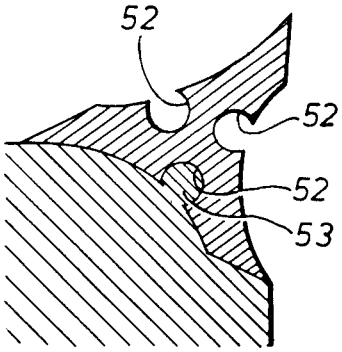
FIG. 9 shows a section through another embodiment of a tool according to the invention and a fastening means therefor.

FIG. 9 shows a variant where the tool and fastening means are provided with co-operating grooves 52 and protrusion 53 having such corresponding shapes, that the tool with its groove 52 must be laterally slid onto the protrusion 53. In this embodiment a separate clamping part is not needed. Alternatively, a conventionally shaped dovetail groove and corresponding protrusion can be used.

Figure 10:
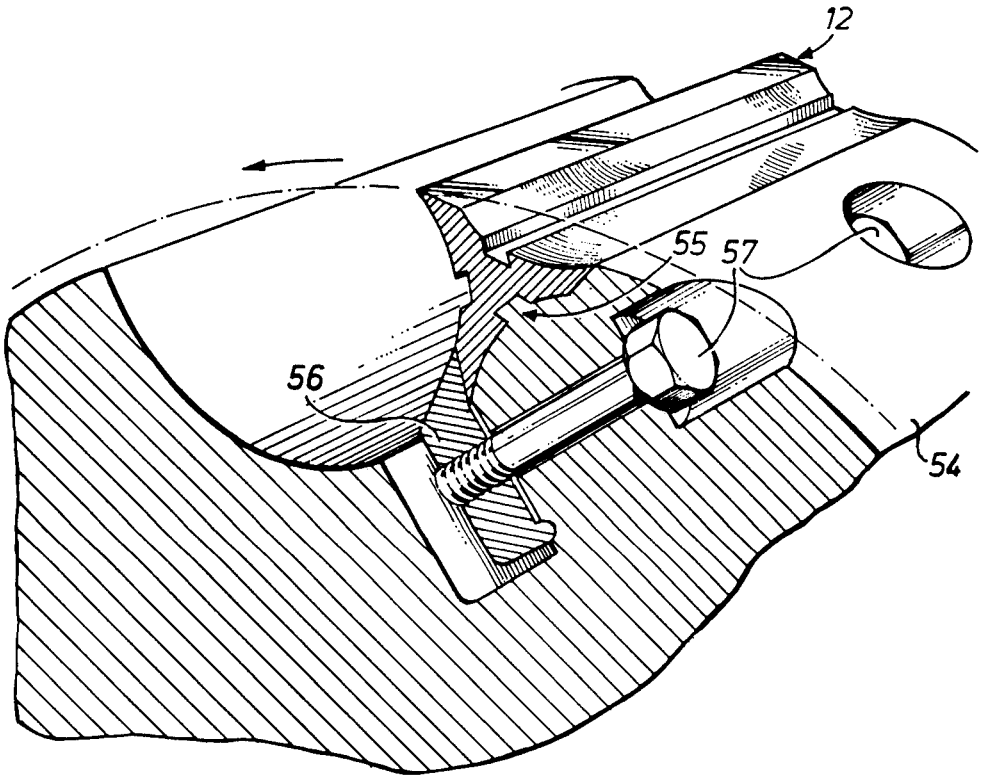
FIG. 10 is a part sectional perspective view showing a tool according to the invention and a still further embodiment of a fastening means therefor.

Finally, FIG. 10 shows a portion of the periphery of a tool carrier 54 in the shape of e.g., a drum chipper carrying a tool 12 according to the invention. In this embodiment, the support part 55 of the fastening means is integral with the tool carrier, while the clamping part 56 thereof is, as before, adapted to clamp and release the tool by means of screws 57.

Both FIG. 3 and FIG. 8 shows how the tool body protects the support part 14 against damage after an edge break occurring between the inoperative grooves 27 and 29.

I claim:

1. A three-edged tool (12) for a woodworking machine, the edges of said tool being arranged with equal angular spacing about a tool body and protruding from said tool body, surfaces (24, 25, 26) for cooperation with means (14, 15) for fastening said tool to a tool carrier (10) being arranged between said edges, wherein distinct recesses (27, 28, 29) are provided in said surfaces (24, 25, 26), said recesses being so shaped as to retain said tool by mating engagement with a correspondingly shaped protrusion (30) provided on said tool carrier (10), and so as to act as a kerf in order to guide a tool breakage in the event of overloading of a tool edge (18) to an area between two of said recesses (27, 28).

2. A tool according to claim 1, wherein said surface (24,25,26) are concavely curved on chip sides of the edges (18,19,20) and merge into clearance surfaces (23,22,21) of succeeding edges (20,19,18), said clearance surfaces being substantially plane and said recesses (27,28,29) being provided in said curved surfaces.

3. A tool according to claim 1 or 2, wherein one surface (29', 28', 27') of each recess (29,28,27) which connects to the chip surface (24,25,26) of an edge forms an angle (v) with the clearance surface (21,22,23) of this edge.

4. A fastening means for a tool according to claim 1 or 2, including a support part (14; 49) for attachment to said tool carrier (10) and a detachable clamping part (15), wherein said support part is provided with a protrusion (30) for mating engagement with a correspondingly shaped recess (27, 28, 29) in said tool, and a support surface (14') for supporting a clearance surface (21, 22, 23) of a non-operative tool edge (18, 19, 20).

5. A fastening means according to claim 7, wherein the clamping part (15;36;46) is provided with a clamping surface (32;40;50) adapted to press against the clearance surface of another non-operative edge.

6. A fastening means according to claim 4, wherein said clamping part in its clamping state rests against the support part merely with an end portion opposed to the clamping surface (32;40;50).

7. A fastening means according to claim 6, wherein said clamping part (15) in its said end portion is provided with a protrusion (33;47) and the support part (14;49) with a corresponding recess (34;48) which are adapted to guide the clamping part (15) relative to the support part (14) upon clamping of a tool.

* * * * *